United States Patent [19]

Lee, Jr.

[11] Patent Number: 4,693,105

[45] Date of Patent: Sep. 15, 1987

[54] METHOD OF AND APPARATUS FOR STRAIGHTENING, SWAGING, AND THREADING A PIPE

[76] Inventor: Roy Lee, Jr., 10134 Briar Dr., Houston, Tex. 77042

[21] Appl. No.: 699,041

[22] Filed: Feb. 7, 1985

Related U.S. Application Data

[63] Continuation-in-part of Ser. No. 540,342, Oct. 11, 1983, abandoned.

[51] Int. Cl.[4] ..... B21D 3/02

[52] U.S. Cl. ..... 72/84; 72/110; 72/122

[58] Field of Search ..... 72/80, 85, 110, 111, 72/122, 123, 84; 10/120.5 R; 285/333

[56] References Cited

U.S. PATENT DOCUMENTS

| | | | |
|---|---|---|---|
| 202,978 | 4/1878 | Atwood | 72/111 |
| 604,664 | 5/1898 | Koelkebeck et al. | 72/123 |
| 816,451 | 3/1906 | Forwood | 72/122 |
| 882,305 | 3/1908 | Fell | 72/122 |
| 1,305,808 | 6/1919 | Key | 72/123 |
| 1,506,988 | 9/1924 | Mirfield | 72/123 |
| 1,942,518 | 1/1934 | Protin | 285/333 |
| 3,656,333 | 4/1972 | Kruse, Jr. | 72/122 |
| 3,791,000 | 2/1974 | Kunze | 72/121 |
| 4,033,163 | 7/1977 | Duffey et al. | 72/121 |

FOREIGN PATENT DOCUMENTS

| | | | |
|---|---|---|---|
| 944318 | 12/1963 | United Kingdom | 72/110 |

*Primary Examiner*—Lowell A. Larson

*Attorney, Agent, or Firm*—Vaden, Eickenroht, Thompson & Boulware

[57] ABSTRACT

A method and apparatus for swaging pipe, straightening hooked end pipe, and expanding undersized pipe for threading is disclosed in which the pipe is gripped adjacent the end to be swaged by a chuck that also rotates the pipe and a swaging tool engages the end of the pipe and forces the pipe to rotate around the common axis of the chuck and the swaging tool. The distance between the chuck and the swaging tool is such that the bending stress produced in the pipe exceeds the yield point of the pipe to thereby straighten the pipe sufficiently for threads to be cut on the pipe.

11 Claims, 16 Drawing Figures

FIG. 3
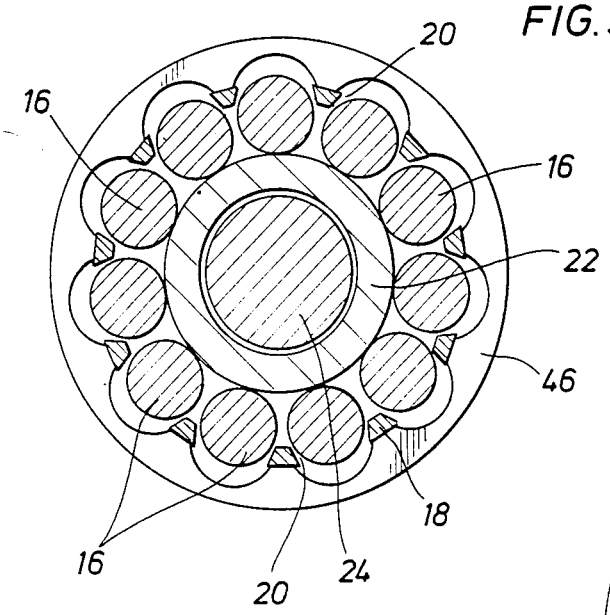
FIG. 4
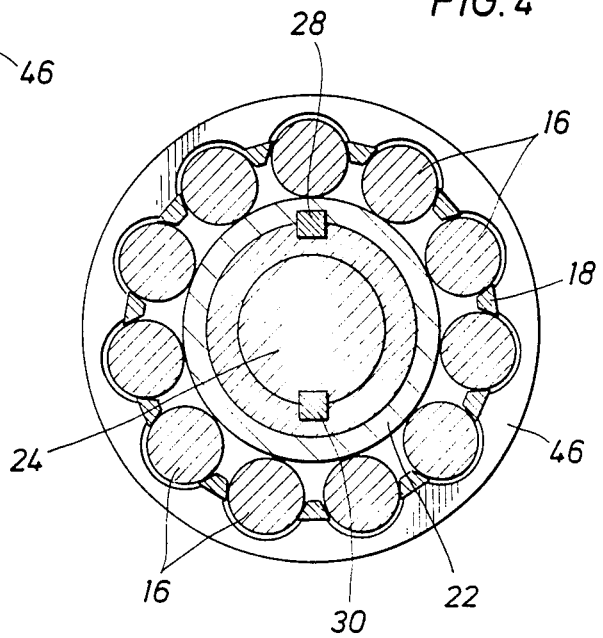
FIG. 5
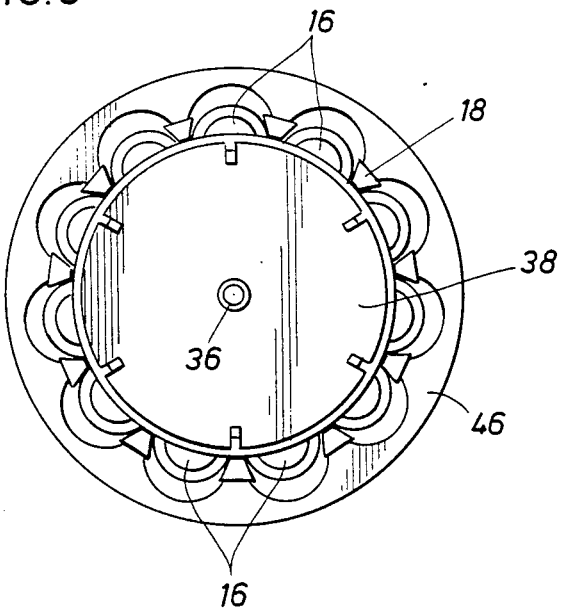
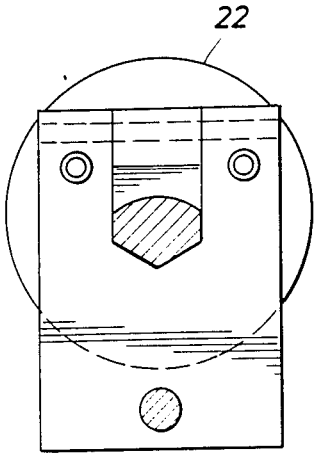
FIG. 6

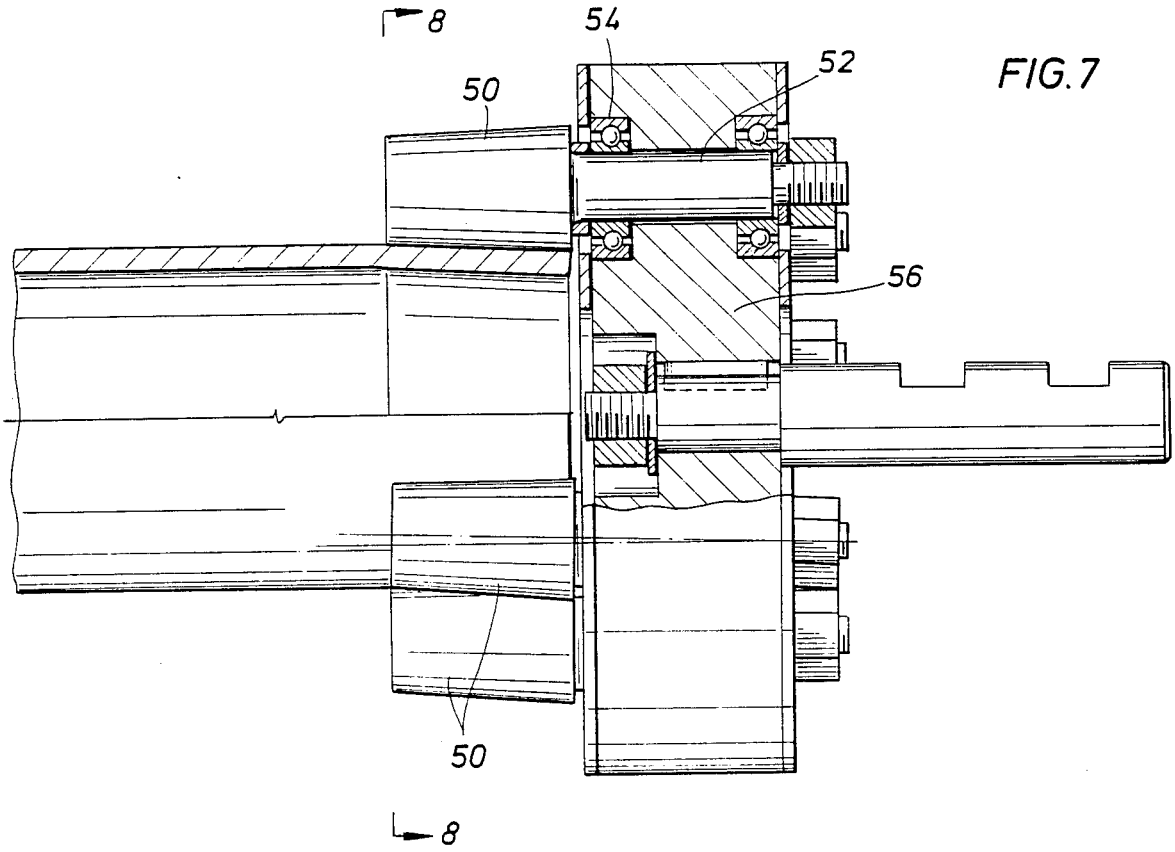
FIG. 7
FIG. 8
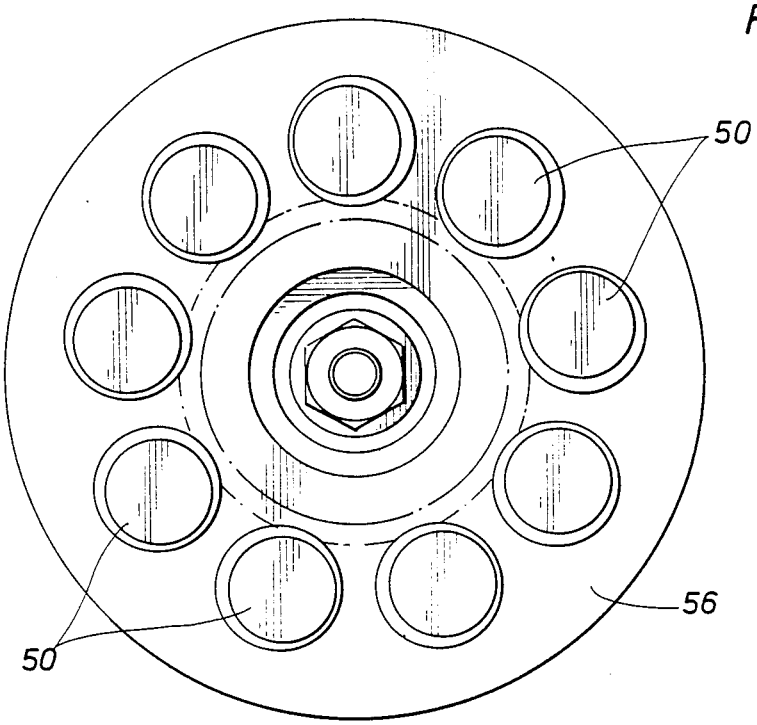

FIG. 9
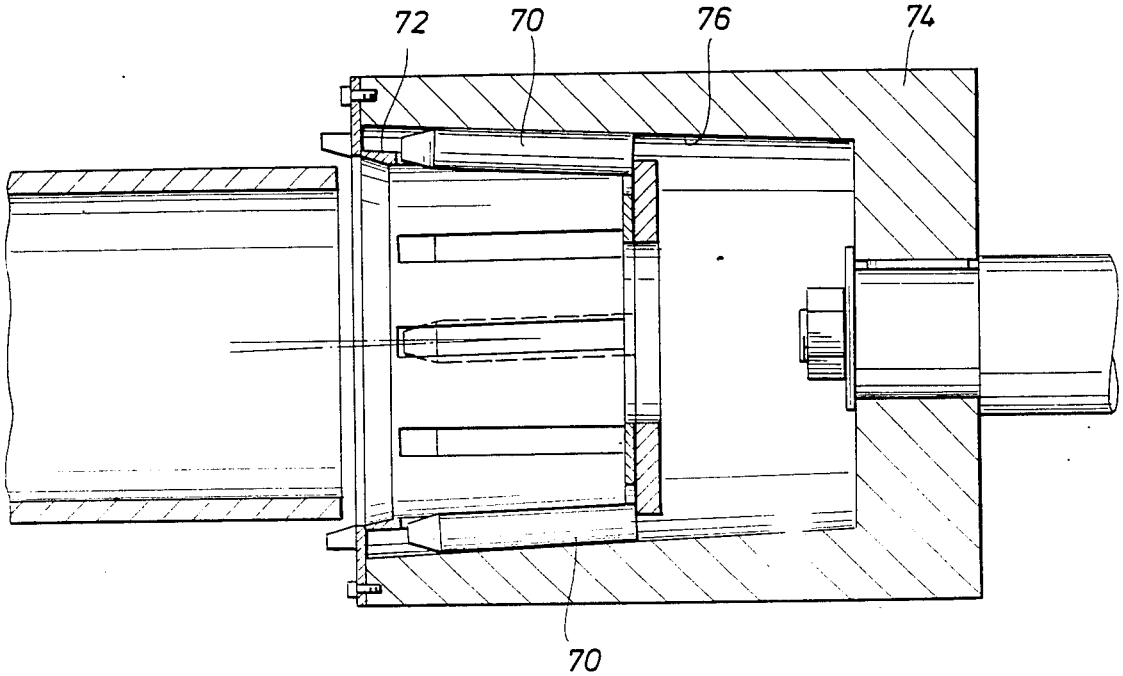
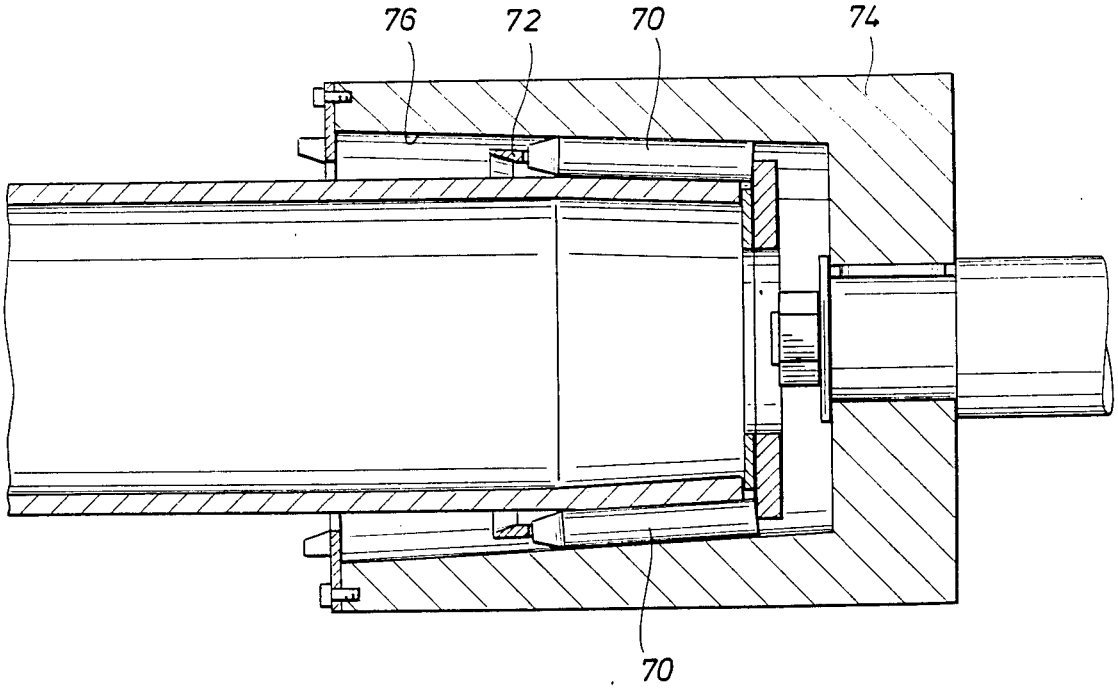
FIG. 10

FIG. 13
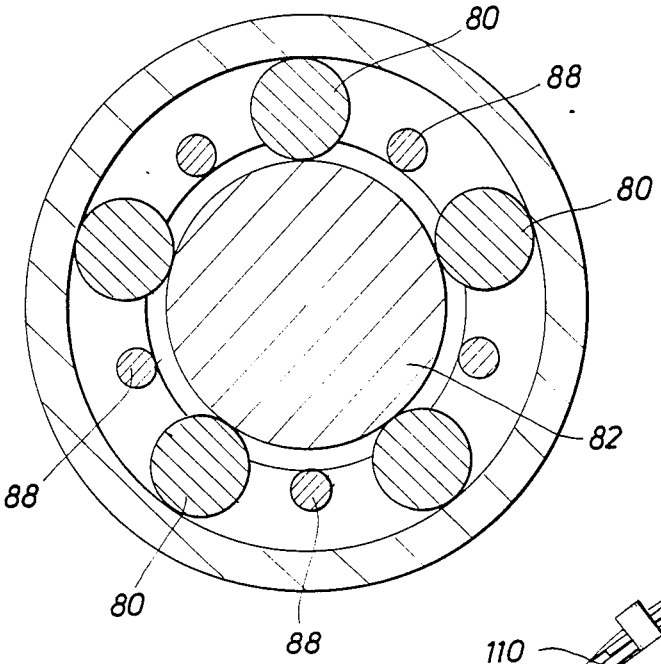
FIG. 14
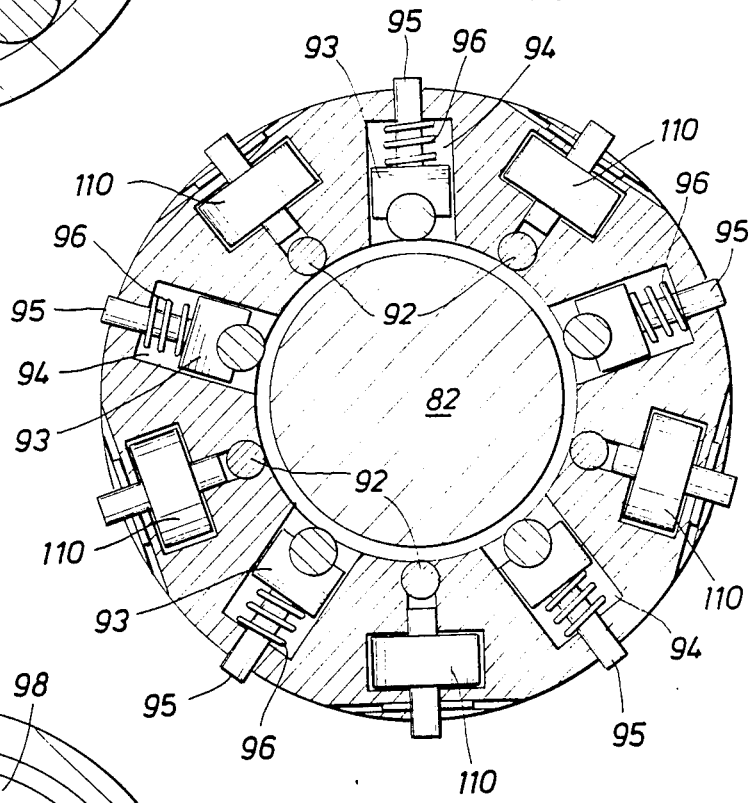
FIG. 15
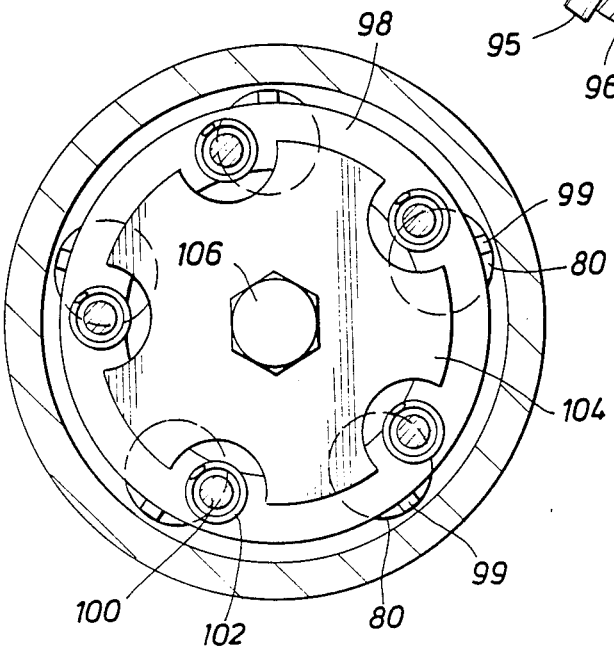
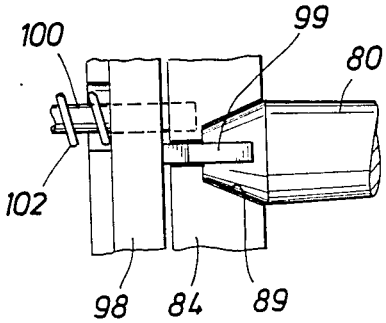
FIG. 16

METHOD OF AND APPARATUS FOR STRAIGHTENING, SWAGING, AND THREADING A PIPE

This is a continuation-in-part of application Ser. No. 540,342, filed Oct. 11, 1983, now abandoned.

This invention relates to a method of and apparatus for swaging pipe, i.e. increasing or decreasing the diameter of the pipe adjacent its end without a substantial change in wall thickness. It also relates to a method of straightening the two to three feet or so adjacent the end of the pipe to be threaded and to a method of and apparatus for threading undersized and out of round pipe.

Oilfield tubular goods, casing, tubing, drill pipe and line pipe are provided with a variety of threads from the premium, such as the well known Hydril threads, to the API standard 8 round threads. All of these threads are cut on run-of-the-mill pipe. A large percentage of such pipe have one or both of the following conditions that make it difficult or impossible to thread the pipe. First, the two to three feet or so adjacent the end of the pipe is crooked. This is called "hooked end" pipe. As such pipe is rotated, the depth of cut taken by the threading tool will vary from the high side to the low side depending on the degree of crookedness of the pipe between the tool and the chuck. Second, the pipe may be undersized with the result that the length of the thread to the vanishing point will be too short.

Prior to threading, the end of the pipe may be upset, which is usually a hot forging procedure, or cold formed, which is usually a swaging operation. Either will solve the problem of undersized pipe. Neither, as presently practiced will solve the problem of hooked ends. In the past, the ends of pipe have been swaged using a swaging tool using a plurality of rollers mounted for rotation about their individual axes. The rollers rotated together around a common axis while being moved into engagement with the pipe to swage the pipe to the desired shape. The swaging tool rotated while the pipe remained stationary or vice versa, (see U.S. Pat. No. 4,033,163). If the swaging tool is rotated and the pipe remained stationary, the end of the hooked end pipe would be bent toward the axis of rotation of the tool during the swaging operation. When released, it would spring back at least part way to its original position. When the pipe was rotated, there is no indication that a straightening resulted or was intended.

In accordance with this invention, it has been discovered that if the pipe is rotated by a chuck that firmly grips the pipe adjacent the end of the pipe and the swaging tool is positioned on the same axis as the chuck, the pipe will be forced to rotate on the same axis and if the chuck and swaging tool are spaced so that the pipe will be stressed beyond its yield point when forced to rotate on the same axis, the end of the pipe will be straightened sufficiently for it to be threaded.

It is, therefore, an object of this invention to provide such a method of straightening the crooked end of a pipe prior to cutting threads on the pipe.

It is a further object of this invention to provide a method of swaging pipe that forms the pipe into the desired shape and also forces the end of the pipe to rotate around a predetermined axis that is also the longitudinal axis of the resulting swaged portion of the pipe so that when the swaged portion is rotated around that axis during threading operations, a uniform cut will be made in the swaged portion.

It is a further object of this invention to provide a method of swaging the end of pipe that includes gripping the pipe within two to three feet of its end with a chuck that rotates the portion of the pipe gripped by the chuck around a fixed axis that coincides with the fixed axis of the roller assembly used to form or swage the end of the pipe, rotating the pipe rather than the roller assembly so that the roller assembly will pull the end of the pipe between the chuck and the roller into alignment with the fixed axis of rotation of the pipe at the chuck thereby straightening substantially the end of the pipe and producing a swaged portion at the end of the pipe that is concentric with the axis of rotation of the pipe at the chuck so that when threads are cut on the swaged portion, the metal removed will be substantially equal completely around the swaged portion.

Straightening the end of the pipe and forming the swaged portion or thread form concentric with the fixed longitudinal axis of the chuck and the rollers in the manner described above, produced a substantial reduction in rejects of the type that previously resulted because the swaged portion was not concentric with the axis of rotation of the pipe.

It is a further object of this invention to provide a method and apparatus for threading undersized pipe by increasing the diameter of the pipe from the vanishing point back toward the end of the pipe as required to cut a thread on the pipe of the required length to the vanishing point.

These and other objects, advantages, and features of this invention will be apparent to those skilled in the art from a consideration of this specification, including the attached drawings and appended claims.

In the drawings:

FIG. 3 is a sectional view taken along line 3—3 of FIG. 1;

FIG. 4 is a sectional view taken along line 4—4 of FIG. 2;

FIG. 5 is a sectional view taken along line 5—5 of FIG. 1;

FIG. 6 is a view looking in the direction of arrows 6—6 of FIG. 1;

FIG. 7 is a side view, partly in elevation and partly in section, of the preferred embodiment of the apparatus of this invention for swaging the end of a pipe prior to cutting external threads thereon;

FIG. 8 is a sectional view taken along line 8—8 of FIG. 7;

FIG. 9 is an alternate embodiment of the apparatus of FIG. 7 for swaging the end of a pipe into the desired shape for external threading;

FIG. 10 is a view similar to FIG. 9 showing the apparatus after it has swaged the end of a pipe;

FIG. 13 is a sectional view taken along line 13—13 of FIG. 12;

FIG. 14 is a sectional view taken along line 14—14 of FIG. 11;

FIG. 15 is a sectional view taken along line 15—15 of FIG. 11; and

FIG. 16 is a view looking in the direction of arrows 16—16 of FIG. 11.

Figure 1:
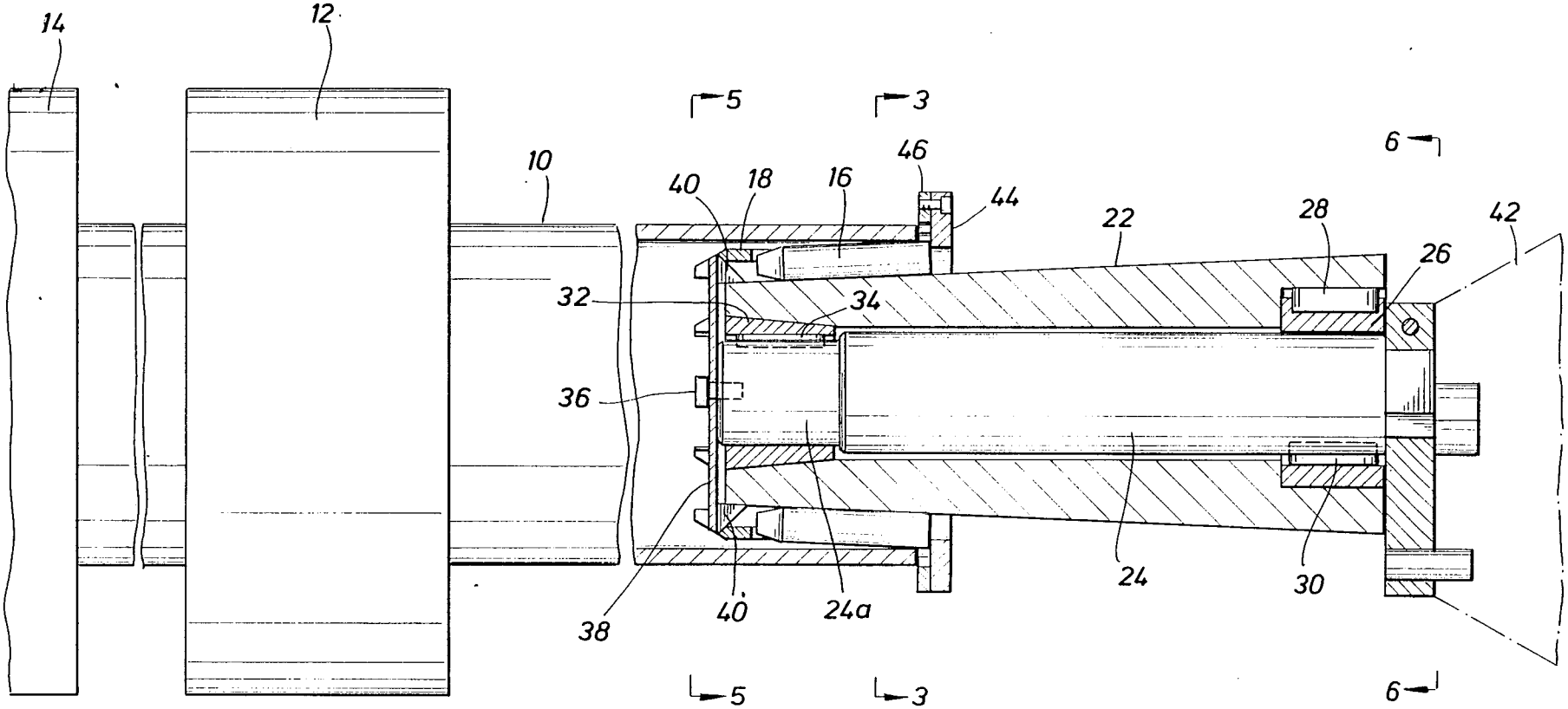
FIG. 1 is a side view, partly in section and partly in elevation, of the apparatus of this invention in position to swage the end of a pipe into a threadform for internal thread in accordance with the method of this invention.
Figure 2:
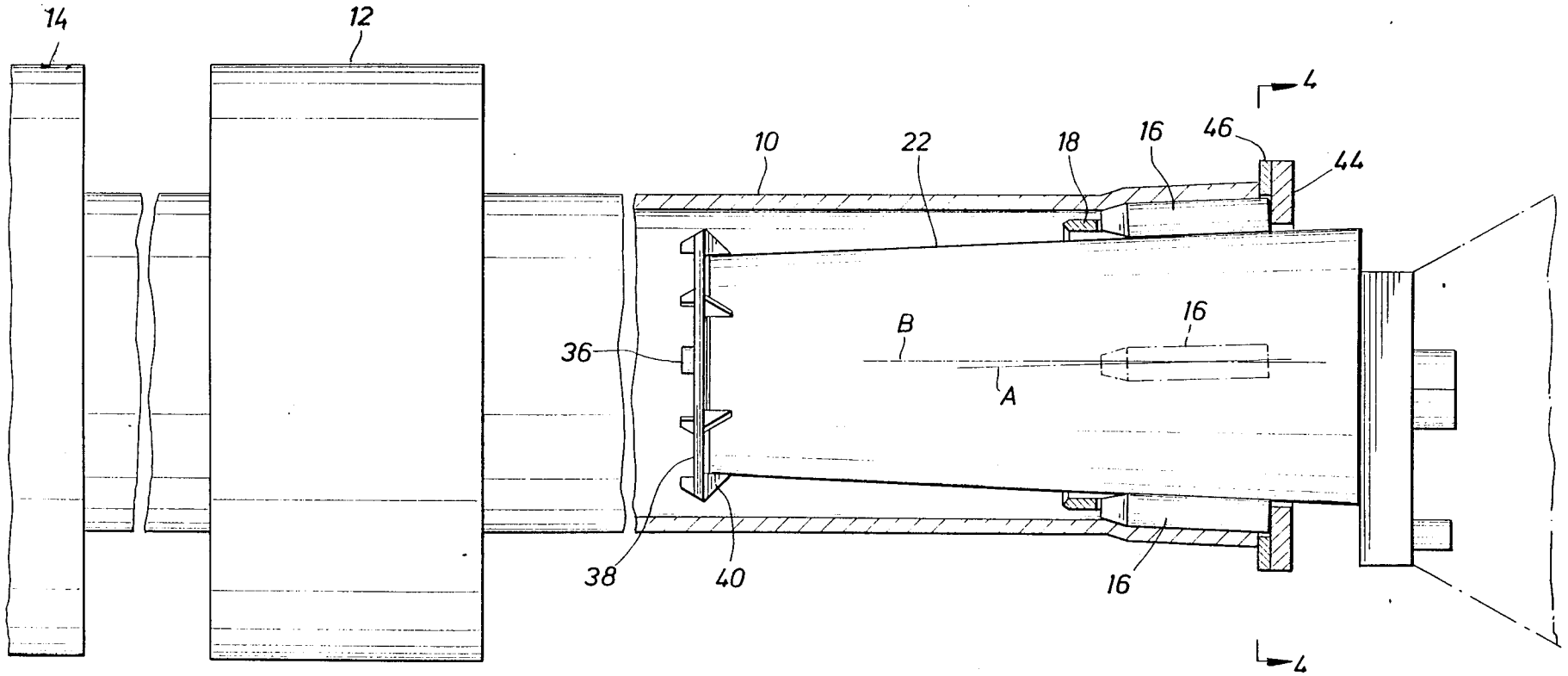
FIG. 2 is a view similar to FIG. 1 where the end of the pipe has been swaged into the desired threadform for internal threads.
Figure 11:
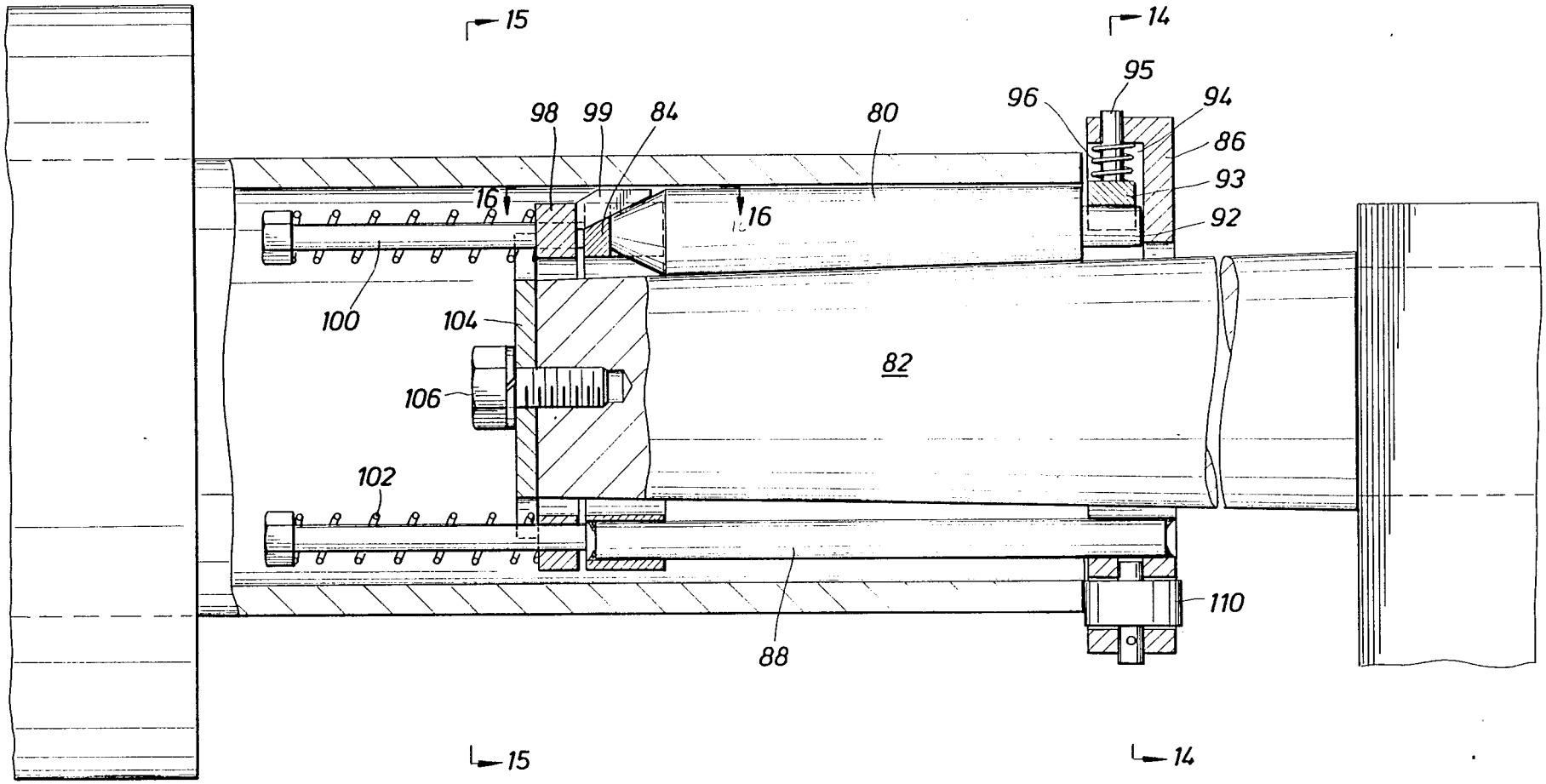
FIG. 11 is a vertical sectional view of an alternate embodiment of the apparatus of this invention for swaging the end of a pipe positioned to swage an undersize pipe.

In accordance with the method of this invention, pipe 10 in FIGS. 1 and 2 is positioned to be gripped by chuck 12 close enough to the end of the pipe to reduce to a minimum the ability of the pipe to bend without exceeding the yield point from the end of the pipe. Chuck 12 rotates the pipe around the fixed axis of the chuck. Preferably second chuck 14 is used to grip the pipe at a point spaced a short distance from chuck 12 to isolate the end of the pipe being swaged from the effect of any lateral movement or wobble of the rest of the pipe as it is rotated.

If the section adjacent the end of the pipe is not straight, i.e., a hooked joint, the method of this invention will straighten it sufficiently as the pipe is being swaged to allow it to be threaded. The swaging tool or apparatus, which will be described below, is moved into engagement with the end of the pipe along the fixed axes of chucks 12 and 14 and, since the pipe is rotating, the section of pipe between the swaging tool and chuck 12 will be forced into alignment with the swaging apparatus and will be substantially straight when the swaging operation is completed. Preferably, the pipe is threaded on the same lathe immediately after the swaging operation. If it is moved to another lathe, the same chuck arrangement should be used, particularly if high cutting speeds are used.

If the end of the pipe does not need to be swaged, but only straightened, then a tool with non-expanded rollers could be used or another chuck.

The preferred embodiment of the swaging apparatus for preparing the end of the pipe for internal threading is shown in FIGS. 1 through 6. It includes a plurality of elongated cylindrical rollers 16 that are mounted for rotation around their longitudinal axes on roller cage 18. The cage comprises a tapered wall cylindrical member having slots therein in which the rollers are held in a parallel spaced relationship around the outside surface of tapered mandrel 22. As shown in FIG. 3, the side walls of longitudinal slots 20 in cage 18 are shaped to limit the distance the rollers can move outwardly from the center line of the apparatus. Tapered mandrel 22 is supported by cylindrical central mandrel 24. On the right hand end, tapered mandrel 22 is keyed to bushing 26 by key 28. Bushing 26, in turn, is keyed to inside mandrel 24 by key 30.

On the left hand end, tapered mandrel 22 has an internal taper that matches tapered bushing 32, which is wedged between the tapered internal surface of tapered mandrel 22 and the cylindrical surface of section 24*a* of reduced diameter at the end of the central mandrel. The tapered bushing is keyed to cylindrical section 24*a* by key 34. Attached to the end of central mandrel 24 by capscrew 36 is roller cage retaining and centering plate 38. When the mandrels are in the position shown in FIG. 1, prior to the swaging operation, wedgelike lugs 40 that are spaced around the periphery of plate 38 engage the end of cage 18 and hold it equidistant from the outside surface of tapered mandrel 22. During the swaging operation, the plate travels with the tapered mandrel out of engagement with the cage, but at this point the end support of the plate is not required.

The entire roller cage mandrel assembly is mounted on tool post 42 of a turret lathe so that the apparatus can be moved longitudinally to the left or right along the fixed axis of the tool post, which coincides with the axes of chucks 12 and 14.

Flange 44 is attached to the rear of cage 18 to support annular spacer 46, which engages the end of the pipe and determines the distance the rollers extend into the end of the pipe.

In operation, the apparatus is moved into the end of the pipe to the position shown in FIG. 1. Pipe 10 is being rotated by chucks 12 and 14. At this point, spacer 46 on the cage engages the end of the pipe and cage 18 and roller 16 cannot move further into the pipe. The mandrel assembly, including central mandrel 24 and tapered mandrel 22, continues moving into the pipe being forced therein by the movement of the tool post of the lathe. The tapered surface of tapered mandrel 22 moves rollers 16 outwardly until they have reached the position shown in FIG. 2 with the end of the pipe being swaged to the desired shape. The tool post is then moved to the right, as viewed in the drawings. The mandrel is withdrawn from underneath the rollers, retaining plate 38 engages end of cage 18 and the entire assembly is removed from the pipe.

It is one of the features of this invention that rollers 16, as best seen in FIG. 2, are canted so that their longitudinal axes indicated by the letter "A" in FIG. 2 is canted from the longitudinal axis "B" of the apparatus, the tool post, and the chucks. Axis "A" is canted in the direction of rotation of the pipe and it has been found that it should be canted between ½° to 5° preferably between 1° and 3°. So canted, as the rollers are forced against the pipe by the tapered mandrel, the canted condition of the rollers will produce a longitudinal force on the mandrel urging it further into the pipe. In other words, it has been discovered that the rollers themselves will pull the mandrel into the pipe and, in fact, in some pipe sizes the lead screw on the turret lathe is used to make sure that the rollers do not pull the mandrel into the pipe too fast thereby creating larger stresses in the apparatus than are expected.

The apparatus shown in FIG. 7 is designed to swage the end of a pipe into a desired thread form prior to external threading. Here, each of rollers 50 has shaft portion 52 integrally connected thereto. The shaft portion is mounted for rotation by bearings 54 in disk shaped support member 56. The rollers are mounted in a circle and tapered to the desired degree to form the preselected shape on the end of the pipe. The rollers are also canted to provide the longitudinal force that will help move the rollers on to the pipe. Support member 56 is mounted in the tool post in the conventional manner and the rollers are moved toward the rotating pipe until they have reached the position shown in FIG. 7 where the end of the pipe has been swaged to the desired shape.

FIGS. 9 and 10 is swaging apparatus of the same type as that shown in FIGS. 1 through 5, but designed to shape the pipe for external threading. Here, rollers 70 are positioned in longitudinal slots in the wall of cage 72 with the slots being arranged to limit the inward movement of the rollers. The actuating device is cupshaped member 74 having an internal tapered bore 76 that moves rollers 70 inwardly as the cupshaped member is moved forward by the tool post to cause the rollers to swage the pipe as shown in FIG. 10.

An alternate embodiment of the swaging tool is shown in FIGS. 11–16. This tool is designed to increase the outer diameter of the pipe adjacent the end of the pipe. Specifically this tool is designed to increase the outside diameter of a pipe at the vanishing point of the thread to be cut on the pipe with the pipe being expanded along a taper that is somewhat less than the taper of the threads to be cut on the pipe to keep the metal that is removed during the threading operation to a minimum.

The swaging tool includes a plurality of rollers 80 spaced equidistantly around tapered mandrel 82. The rollers are held against longitudinal movement by a roller cage that includes roller cage front flange 84 and roller cage rear flange 86. The front flange and rear flange are connected by longitudinally extending rods 88 that are located between the rollers and extend into openings provided in the flanges to provide lateral stability to the cage. The rods are welded to the flanges.

The rear end of the rollers are of reduced diameter to provide stub shafts 92. These shafts are engaged by retainer blocks 93 that are located in notches 94 provided in the rear flange. Pins 95 are connected to retainer blocks 93 and extend through openings provided in the outer edge of the rear flange. Coil springs 96 through the retainer blocks and stub shaft urge the rollers toward tapered mandrel 82. But as the tapered mandrel moves forward to move the rollers outwardly to expand the pipe, the retainer blocks will move with the rollers by compressing springs 97.

Figure 12:
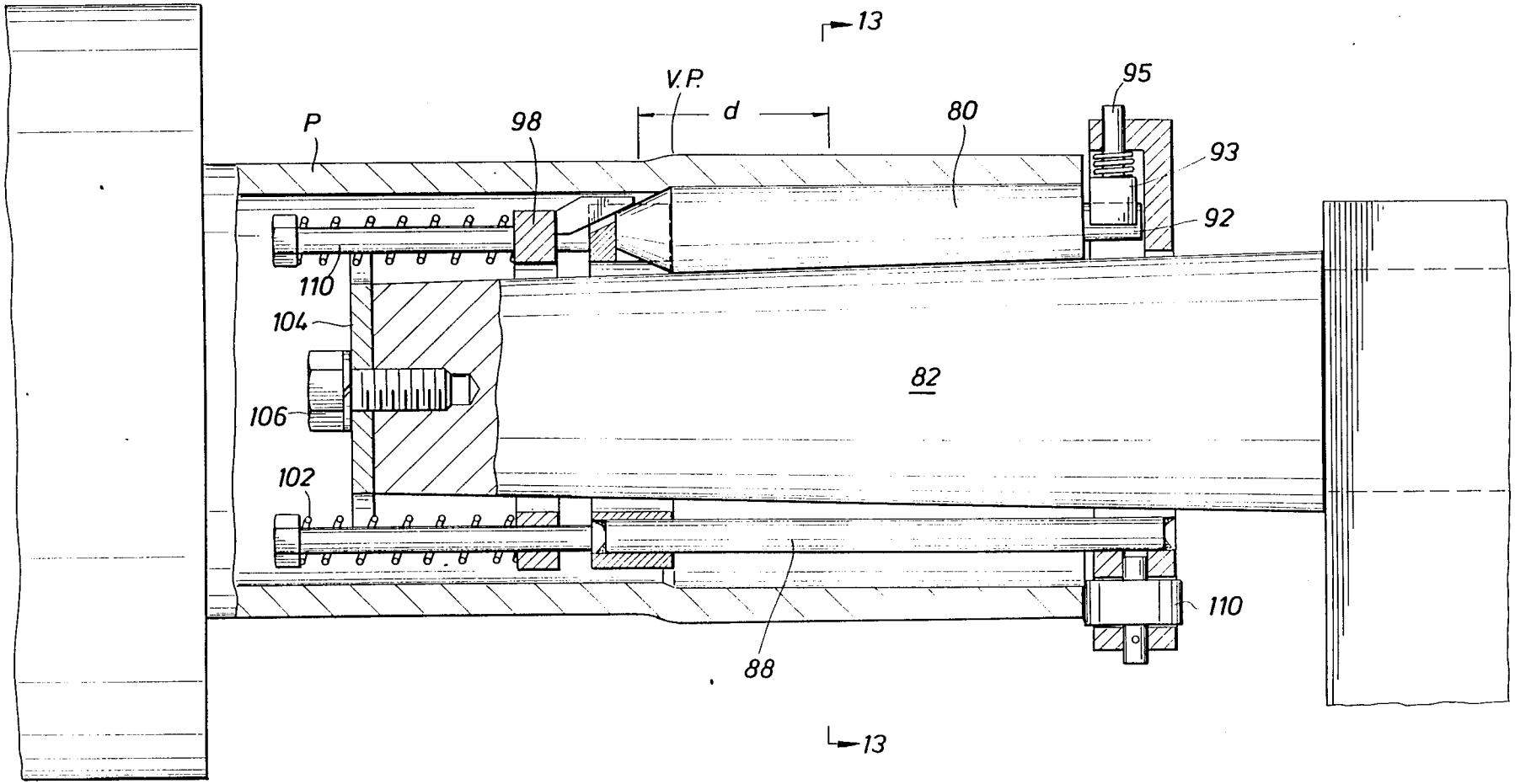
FIG. 12 is a view similar to FIG. 11 showing the apparatus after it has increased the diameter of the pipe at the vanishing point sufficiently for the pipe to be threaded.

The front ends of the rollers are allowed to expand outwardly against a spring force that will hold the rollers against the tapered surface of mandrel 82 so that when the mandrel is withdrawn, the rollers will be pulled inwardly into a position where the tool can be removed from the pipe. In the embodiment shown, expanding roller front retainer includes annular member 98 that has a plurality of lugs 99 attached to it. The lugs have tapered surfaces 99*a* and are positioned for their tapered surfaces to engage the tapered front ends of the rollers. A plurality of bolts 100 extend through openings in front retainer 98 and are connected to front flange 84. Coil springs 102 resist the movement of front retainer member 98 away from front flange 84 so that as shown in FIG. 12, as the rollers are moved outwardly by the movement of tapered mandrel 82 to the left into the pipe, springs 102 will be compressed and continually urge lugs 99 to move the rollers inwardly away from the pipe.

Retainer plate 104 is attached to the forward end of tapered mandrel 82 by bolt 106. As shown in FIG. 15, plate 104 is provided with notches to allow bolts 100 to extend therethrough, but will engage roller retainer 98 as the mandrel is moved to the right as viewed in the drawings, and carry the roller retainer with it out of the pipe.

As explained above, it is one of the features of this invention to provide a method and apparatus for expanding undersized pipe in a manner that allows the pipe to be threaded properly, but keeps the amount of metal displaced to a minimum and also the amount of metal that needs to be removed to cut the thread to a minimum. As shown in FIG. 12, rollers 80 have expanded the end of the pipe to the proper diameter for an external thread to be cut on the pipe. The problem with cutting a thread on undersized pipe is not at the front end of the pipe, it is at the end of the thread. Because as the cutting tool follows the desired taper of the thread, it runs out of metal before it should and the length of the thread is not acceptable. Even in properly cut threads, of course, the threading tool will begin to move away from the metal due to the taper upon which it is cutting and will move out of engagement with the metal at the vanishing point of the thread. Therefore, in accordance with this invention, pipe P which is undersized, need only be expanded to the proper dimension at the vanishing point and if this is done with the remainder of the pipe between the vanishing point and the end of the pipe being expanded along a taper that is somewhat less than that of the thread to be cut, the minimum amount of metal will have been displaced to allow an acceptable thread to be cut. In the drawings, the amount of expansion of the pipe is exaggerated. The maximum expansion will probably be 25 to 30 thousands of an inch on the diameter.

For example, this tool was used to salvage some $5\frac{1}{2}''$ OD N-80 casing that was slightly undersized, that had hooked ends, and was out of round, all to the extent that it could not be threaded in a conventional threading plant. Using the tool shown in FIGS. 11–16, with a mandrel having a taper of $\frac{1}{4}''$ per foot and rollers having a negative taper of $\frac{1}{2}''$ per foot, the area at the vanishing point (VP) was increased in diameter about 0.050 of an inch and the resulting taper feathered out at a taper less than the thread blank taper so that the tool was working on less than two inches of pipe length.

The position of the tool in the pipe is determined by the engagement of rear flange 86 with the end of the pipe. The pipe ends are usually rough and the rotation of the pipe against the stationary flange will not produce a very smooth operation. Therefore, a plurality of rollers 110 are mounted around the periphery of the rear flange to engage the end of the pipe and allow the pipe to rotate relative to the tool with a minimum of friction. Since the tool is designed for use on a range of sizes, the distance from the end of the pipe to the vanishing point, VP, will vary. Therefore, spacers can be placed between the end of the pipe and rollers 110 to precisely locate the rollers to expand the pipe at the vanishing point.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A method of swaging the end of a pipe for threading comprising the steps of rotating the pipe around its longitudinal axis, gripping the pipe with a chuck at a location close enough to the end to be swaged to create bending stresses in the pipe above its yield point when the pipe is forced to rotate on the axis of rotation of the chuck, and moving a plurality of rollers along the axis of rotation of the chuck into engagement with the end of the rotating pipe to force the end of the pipe to rotate around the axis of rotation of the chuck thereby straightening the end of the pipe between the chuck and the rollers and to swage the pipe into the desired thread form concentric with the fixed axis of rotation of the end of the pipe whereby threads can be cut on the thread form that are concentric with the end of the pipe.

2. The method of claim 1 in which the chuck is within two feet or less from the end of the pipe.

3. The method of claim 1 in which the chuck grips the pipe about twelve inches or less from the end of the pipe.

4. The method of claim 1 having the further step of gripping the pipe with a second chuck spaced from the first chuck to force the pipe to rotate around the same fixed axis at both chucks.

5. A method of preparing undersized pipe for threading comprising the steps of rotating the pipe around its longitudinal axis, gripping the pipe with a chuck at a location adjacent the end to be threaded to force the pipe at the chuck to rotate around a fixed axis, moving a plurality of rollers spaced radially from the fixed axis of the chuck into engagment with the inside surface of the pipe adjacent the end of the rotating pipe to force the end of the pipe to rotate around the fixed axis of the chuck and moving the rollers radially equal distances to increase the diameter of the pipe at the vanishing point to the proper diameter for the threads to be cut and to taper the pipe from the vanishing point to the end of the pipe along a taper that equals or is somewhat less than the taper of the threads to be cut to allow a full thread to be cut on the pipe and to reduce the metal that is removed when the pipe is threaded.

6. The method of claim 5 in which the chuck grips the pipe close enough to the end of the pipe to produce a bending stress in the pipe beyond the yield point of the pipe to straighten the pipe if the end of the pipe is sufficiently crooked to produce such stress when forced to rotate on the axis of the chuck.

7. The method of claim 5 having the further step of gripping the pipe with a second chuck spaced from the first chuck to force the pipe to rotate around the same fixed axis at both chucks.

8. A method of straightening the end of a pipe having a hooked end for threading comprising the steps of rotating the pipe around its longitudinal axis, gripping the pipe with a chuck at a location close enough to the end to be straightened to produce a bending stress above the yield point of the pipe when the pipe is forced to rotate around the fixed axis of the chuck, and forcing the end of the pipe to rotate around the fixed axis of the chuck thereby straightening the pipe sufficiently for threads to be cut thereon.

9. The method of claim 8 in which the chuck engages the pipe two feet or less from the end of the pipe.

10. The method of claim 8 in which the chuck grips the pipe about twelve inches or less from the end of the pipe.

11. The method of claim 8 having the further step of gripping the pipe with a second chuck spaced from the first chuck to force the pipe to rotate around the same fixed axis at both chucks.

* * * * *